US010712071B2

(12) United States Patent
Rosell

(10) Patent No.: US 10,712,071 B2
(45) Date of Patent: Jul. 14, 2020

(54) COLD STORAGE ASSEMBLY

(71) Applicant: Michael Rosell, Hillsboro, OR (US)

(72) Inventor: Michael Rosell, Hillsboro, OR (US)

( * ) Notice: Subject to any disclaimer, the term of this patent is extended or adjusted under 35 U.S.C. 154(b) by 91 days.

(21) Appl. No.: 16/032,622

(22) Filed: Jul. 11, 2018

(65) Prior Publication Data

US 2020/0018536 A1 Jan. 16, 2020

(51) Int. Cl.

| | |
|---|---|
| ***F25D 3/10*** | (2006.01) |
| ***F25D 23/06*** | (2006.01) |
| ***F25D 11/00*** | (2006.01) |
| ***F25D 16/00*** | (2006.01) |

(52) U.S. Cl.

CPC ..... *F25D 3/107* (2013.01); *F25D 3/105* (2013.01); *F25D 11/003* (2013.01); *F25D 23/069* (2013.01); *F25D 2331/804* (2013.01)

(58) Field of Classification Search

CPC ..... F25D 3/107; F25D 23/069; F25D 11/003; F25D 3/105; F25D 2331/804

USPC ..... 62/344

See application file for complete search history.

(56) References Cited

U.S. PATENT DOCUMENTS

| | | | | |
|---|---|---|---|---|
| 4,288,996 | A | 9/1981 | Roncaglione | |
| 4,530,220 | A | 7/1985 | Nambu | |
| 5,231,850 | A | 8/1993 | Morris | |
| D373,514 | S | 9/1996 | Melk | |
| 5,570,588 | A | 11/1996 | Lowe | |
| 6,675,606 | B1 | 1/2004 | Jones | |
| 6,799,434 | B1 | 10/2004 | Hobbs, Jr. | |
| 7,874,177 | B2 | 1/2011 | Azamy | |
| 8,424,319 | B2 | 4/2013 | Whewell, Jr. | |
| 2004/0139757 | A1* | 7/2004 | Kuehl | B60H 1/00592 62/237 |
| 2007/0241154 | A1* | 10/2007 | Potts | B60R 7/02 224/539 |
| 2017/0036844 | A1* | 2/2017 | Seiders | A45C 3/00 |

* cited by examiner

*Primary Examiner* — Steve S Tanenbaum

(57) ABSTRACT

A cold storage assembly for maintaining a temperature of an item includes a shell that defines an interior space. The shell comprises membranous polymer so that the shell is flexible. The shell has a top that is open. A lid is pivotally coupled to a back of the shell adjacent to the top. The shell is configured to insert items into the interior space and the lid is positioned to selectively close the top. A plurality of panels is selectively couplable to an inner surface of the shell. The panels extend between a front and a back of the shell and define a plurality of compartments. The panels are configured to separate the items. A cooling unit that comprises an evaporator and a condenser is coupled to the shell. The cooling unit is positioned to cool the interior space and the items that are positioned therein.

17 Claims, 4 Drawing Sheets

COLD STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to a new storage assembly for maintaining a temperature of an item.

(2) Description of Related Art Including Information Disclosed Under 37 CFR 1.97 and 1.98

The prior art relates to storage assemblies.

BRIEF SUMMARY OF THE INVENTION

An embodiment of the disclosure meets the needs presented above by generally comprising a shell that defines an interior space. The shell comprises membranous polymer so that the shell is flexible. The shell has a top that is open. A lid is pivotally coupled to a back of the shell adjacent to the top. The shell is configured to insert items into the interior space and the lid is positioned to selectively close the top. A plurality of panels is selectively couplable to an inner surface of the shell. The panels extend between a front and a back of the shell and define a plurality of compartments. The panels are configured to separate the items. A cooling unit that comprises an evaporator and a condenser is coupled to the shell. The cooling unit is positioned to cool the interior space and the items that are positioned therein.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
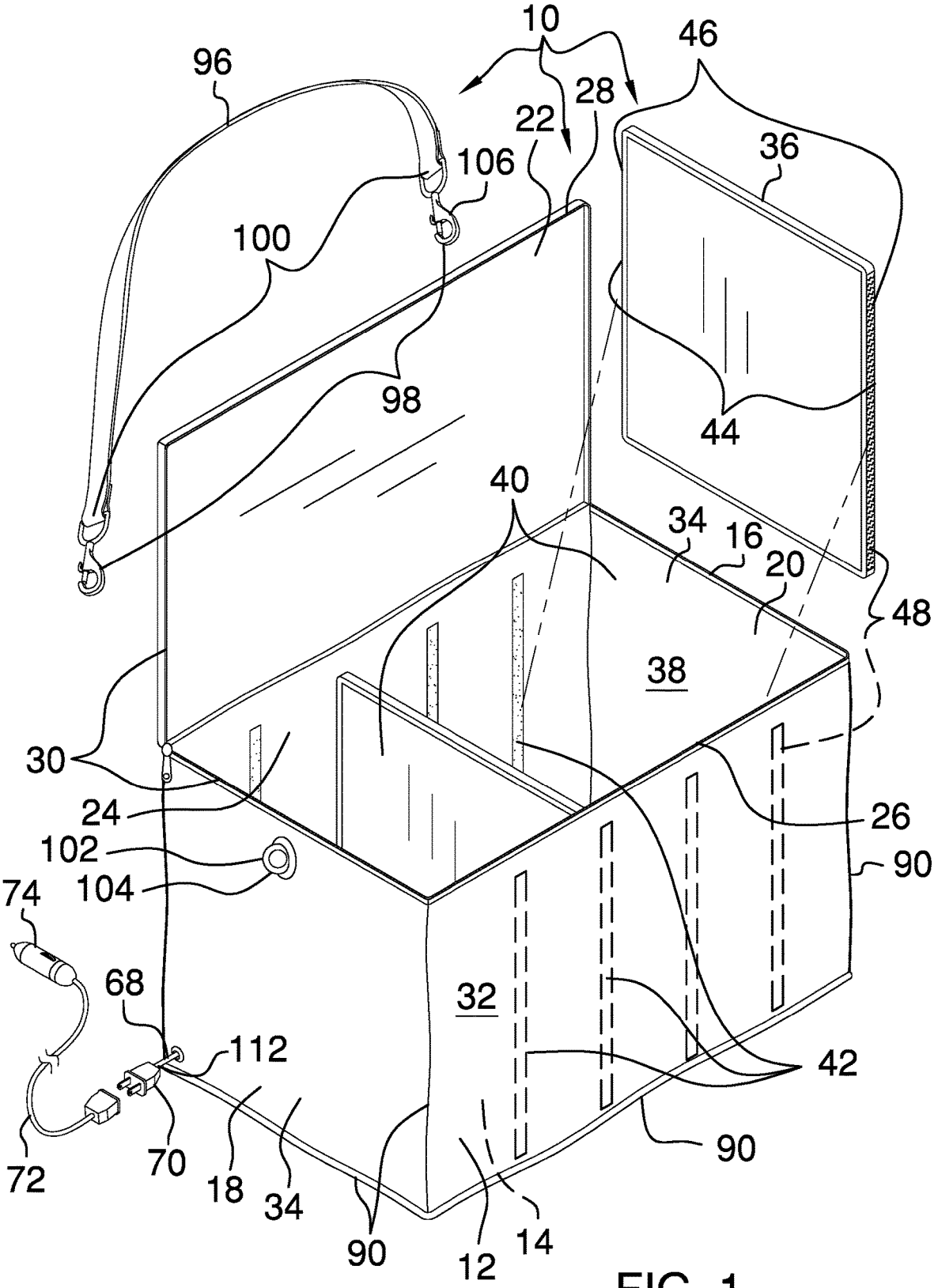
FIG. 1 is an isometric perspective view of a cold storage assembly according to an embodiment of the disclosure.
Figure 2:
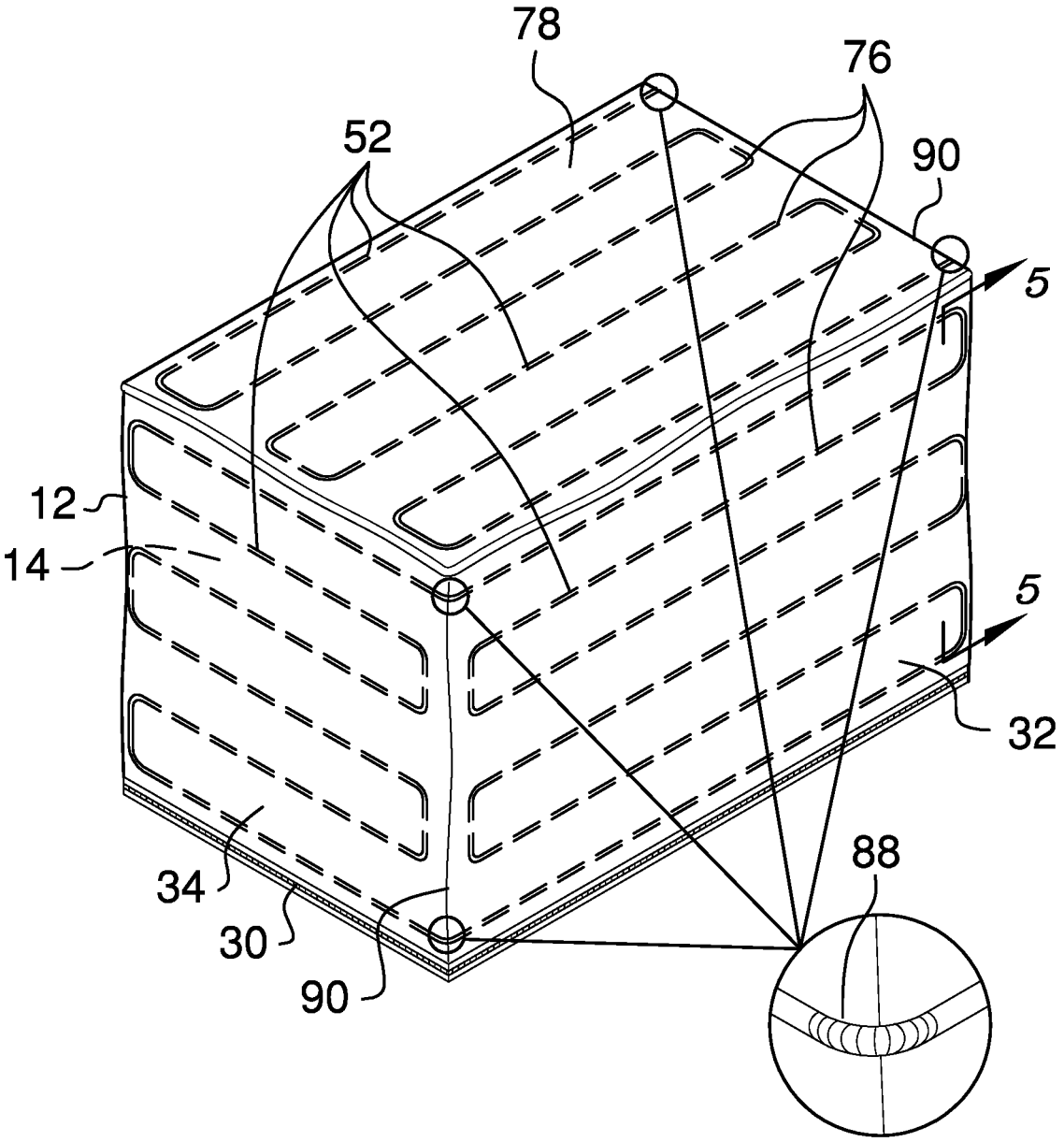
FIG. 2 is a bottom isometric perspective view of an embodiment of the disclosure.

With reference now to the drawings, and in particular to FIGS. 1 through 4 thereof, a new storage assembly embodying the principles and concepts of an embodiment of the disclosure and generally designated by the reference numeral 10 will be described.

As best illustrated in FIGS. 1 through 4, the cold storage assembly 10 generally comprises a shell 12 that defines an interior space 14. The shell 12 comprises membranous polymer, such as vinyl or nylon, so that the shell 12 is flexible. The shell 12 has a top 16 that is open so that the shell 12 is configured to insert items into the interior space 14. The shell 12 is substantially rectangularly box shaped. The shell 12 comprises an outer layer 18 and an inner layer 20. The outer layer 18 is insulated. The inner layer 20 is thermally conductive.

A lid 22 is pivotally coupled to a back 24 of the shell 12 adjacent to the top 16. The lid 22 is positioned to selectively close the top 16. A first coupler 26 is coupled to the shell 12 proximate to the top 16. A second coupler 28 is coupled to the lid 22. The second coupler 28 is complementary to the first coupler 26. The second coupler 28 is positioned to selectively couple to the first coupler 26 to couple the lid 22 to the shell 12 to close the top 16. The first coupler 26 and the second coupler 28 comprise a zipper 30. The zipper 30 extends along a front 32 and opposing sides 34 of the shell 12 adjacent to the top 16.

A plurality of panels 36 is selectively couplable to an inner surface 38 of the shell 12, as shown in FIG. 1. The panels 36 extend between the front 32 and a back 24 of the shell 12 and define a plurality of compartments 40. The panels 36 are configured to separate the items that are positioned in the interior space 14.

A plurality of first fasteners 42 is coupled to the inner surface 38 of the shell 12. Each of a plurality of second fasteners 44 is coupled to a respective panel 36. The second fasteners 44 are complementary to the first fasteners 42. Each second fastener 44 is positioned to selectively couple to a respective first fastener 42 to couple the respective panel 36 to the shell 12. The plurality of second fasteners 44 comprises eight second fasteners 44 that are positioned singly on opposing edges 46 of four panels 36. Each second fastener 44 and the respective first fastener 42 comprise a hook and loop fastener 48.

Figure 3:
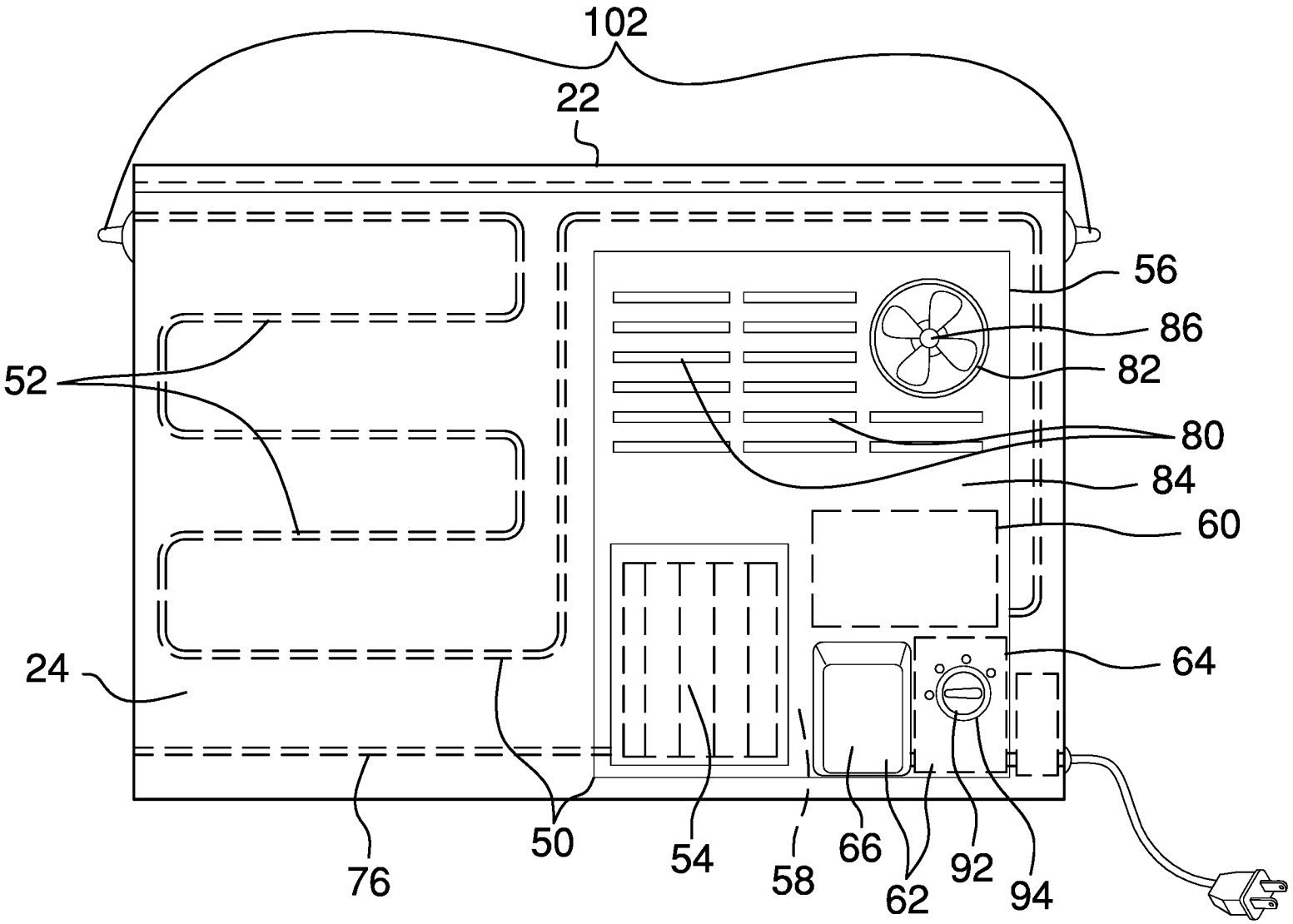
FIG. 3 is a back view of an embodiment of the disclosure.

A cooling unit 50 is coupled to the shell 12. The cooling unit 50 comprises an evaporator 52 and a condenser 54 so that the cooling unit 50 is positioned to cool the interior space 14 and the items that are positioned therein. The cooling unit 50 comprises a housing 56 that defines an internal space 58. The housing 56 is coupled to the back 24 of the shell 12, as shown in FIG. 3. The condenser 54, a compressor 60, and a power module 62 are coupled to the housing 56 and are positioned in the internal space 58.

The power module 62 comprises a power supply unit 64, as shown in FIG. 3. A battery 66 is operationally coupled to the power supply unit 64. The battery 66 is rechargeable. A cable 68 is operationally coupled to the power supply unit 64. The cable 68 is selectively extensible from the housing 56. A cable connector 70 is coupled to a terminus 112 of the cable 68. The cable connector 70 is configured to couple the cable 68 to a source of alternating current to supply alternating current to the power supply unit 64. The power supply unit 64 is positioned to convert the alternating current to direct current to power the compressor 60 and to charge the battery 66. In the absence of a source of alternating current, the battery 66 is positioned to power the compressor 60.

An adaptor 72 is selectively couplable to the cable connector 70, as shown in FIG. 1. The adaptor 72 comprises a cigarette lighter plug 74. The adaptor 72 is configured to couple the cable 68 to a source of direct current to supply direct current to the power supply unit 64. The power supply unit 64 is positioned to supply the direct current to power the compressor 60 and to charge the battery 66.

The compressor 60 is operationally coupled to the power module 62, the evaporator 52, and the condenser 54. The evaporator 52 comprises a conduit 76 that is positioned between the outer layer 18 and the inner layer 20. The conduit 76 is coupled to and extends between the condenser 54 and the compressor 60. The conduit 76 is loopedly positioned in the back 24, a bottom 78, and the opposing sides 34 of the shell 12.

A plurality of slots 80 and an orifice 82 are positioned through a rear wall 84 of the housing 56. The slots 80 are configured to vent the internal space 58 to cool the condenser 54. A fan 86 is positioned in the orifice 82 and is coupled to the housing 56. The fan 86 is operationally coupled to the power module 62. The fan 86 is configured to force air through the internal space 58 to cool the condenser 54.

The evaporator 52 also comprises a plurality of tubes 88. The tubes 88 are pleated so that the tubes 88 are flexible. Each tube 88 is positioned in the conduit 76 so that the tube 88 is positioned around a respective edge 90 of the shell 12. The tubes 88 are configured to facilitate folding of the shell 12.

A controller 92 is coupled to the rear wall 84 of the housing 56. The controller 92 is operationally coupled to the power module 62 and the compressor 60. The controller 92 is positioned to control a level of cooling of the interior space 14. The controller 92 comprises a knob 94. The knob 94 is rotatable relative to the housing 56 to select the level of cooling.

The assembly 10 also comprises a strap 96, as shown in FIG. 1. Each of a pair of first connectors 98 is coupled to a respective opposing end 100 of the strap 96. Each of a pair of second connectors 102 is coupled to a respective opposing side 34 of the shell 12 proximate to the top 16. The second connectors 102 are complementary to the first connectors 98. Each second connector 102 is positioned to selectively couple to a respective first connector 98 to couple the strap 96 to the shell 12. The strap 96 is configured to position on a shoulder of the user to carry the shell 12. Each second connector 102 comprises a ring 104. Each first connector 98 comprises a snap hook 106.

Figure 4:
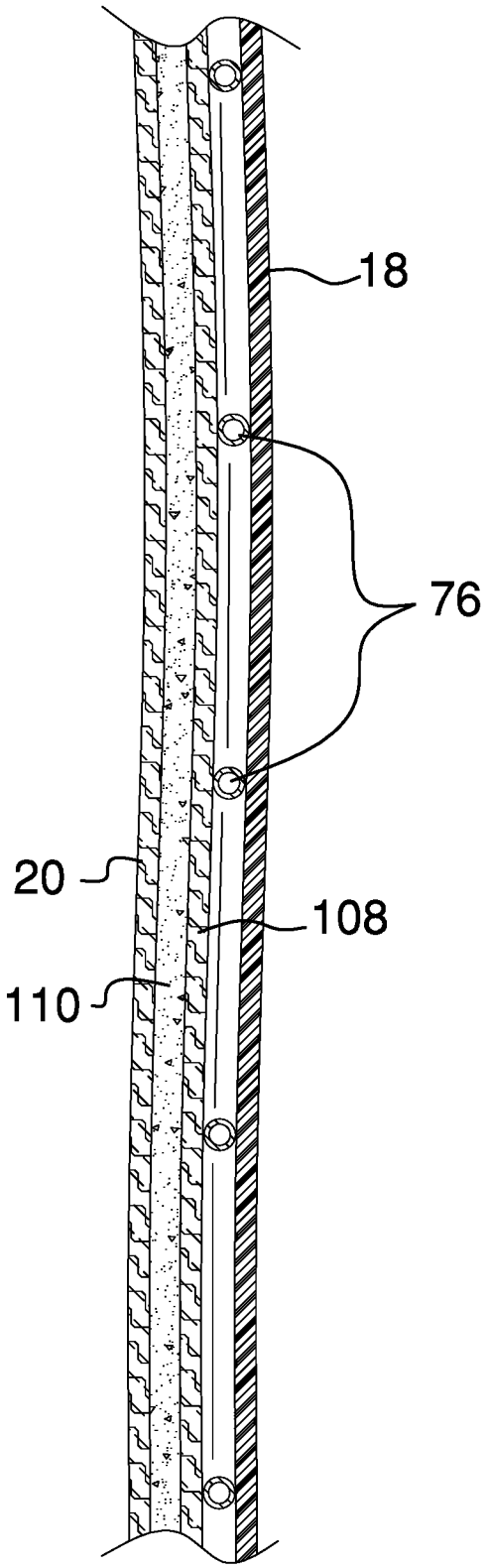
FIG. 4 is a cross-sectional view of an embodiment of the disclosure.

In another embodiment, as shown in FIG. 4, the shell 12 comprises a medial layer 108 that is positioned between the outer layer 18 and the inner layer 20. The medial layer 108 is thermally conductive. The conduit 76 is positioned between the outer layer 18 and the medial layer 108. A phase-change material 110 is positioned between the inner layer 20 and the medial layer 108. The phase-change material 110 is configured to absorb heat through the inner layer 20 from the interior space 14 to cool the interior space 14 and the items that are positioned therein. The medial layer 108 is configured to conduct heat from the phase-change material 110 to the conduit 76 to cool the phase-change material 110.

In use, the panels 36 are coupled to the inner surface 38 of the shell 12 to create a desired number of compartments 40. The items are positioned in the compartments 40 and separation is maintained by the panels 36. The knob 94 is used to select a desired level of cooling.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cold storage assembly comprising:

a shell defining an interior space, said shell comprising membranous polymer such that said shell is flexible, said shell having a top, said top being open wherein said shell is configured for inserting items into said interior space said shell comprising an outer layer and an inner layer, said outer layer being insulated, said inner layer being thermally conductive;

a lid pivotally coupled to a back of said shell adjacent to said top wherein said lid is positioned for selectively closing said top;

a plurality of panels selectively couplable to an inner surface of said shell such that said panels extend between a front and a back of said shell defining a plurality of compartments wherein said panels are configured for separating the items; and a cooling unit coupled to said shell, said cooling unit comprising an evaporator said evaporator comprising a conduit positioned between said outer layer and said inner layer, a condenser, wherein said cooling unit is positioned for cooling said interior space and the items positioned therein, a housing defining an internal space, said condenser being coupled to said housing and positioned in said internal space, a power module coupled to said housing and positioned in said internal space, and a compressor coupled to said housing and positioned in said internal space, said compressor being operationally coupled to said power module, said evaporator, and said condenser, said conduit being coupled to and extending between said condenser and said compressor, said conduit being loopedly positioned in said back, a bottom, and opposing sides of said shell.

2. The assembly of claim 1, further including said shell being substantially rectangularly box shaped.

3. The assembly of claim 1, further including said housing being coupled to said back of said shell.

4. The assembly of claim 1, further including a plurality of tubes, said tubes being pleated such that said tubes are flexible, each said tube being positioned in said conduit such that said tube is positioned around a respective edge of said shell wherein said tubes are configured for facilitating folding of said shell.

5. The assembly of claim 1, further comprising:

a plurality of slots positioned through a rear wall of said housing wherein said slots are configured for venting said internal space for cooling said condenser;

an orifice positioned through said rear wall of said housing; and a fan positioned in said orifice and coupled to said housing, said fan being operationally coupled to said power module wherein said fan is configured for forcing air through said internal space for cooling said condenser.

6. The assembly of claim 1, further comprising:

said shell comprising a medial layer positioned between said outer layer and said inner layer, said medial layer being thermally conductive, said conduit being positioned between said outer layer and said medial layer; and a phase-change material positioned between said inner layer and said medial layer wherein said phase-change material is configured for absorbing heat through said inner layer from said interior space for cooling said interior space and the items positioned therein, wherein said medial layer is configured for conducting heat from said phase-change material to said conduit for cooling said phase-change material.

7. The assembly of claim 1, further comprising:

a first coupler coupled to said shell proximate to said top; and a second coupler coupled to said lid, said second coupler being complementary to said first coupler wherein said second coupler is positioned for selectively coupling to said first coupler for coupling said lid to said shell for closing said top.

8. The assembly of claim 7, further including said first coupler and said second coupler comprising a zipper, said zipper extending along said front and opposing sides of said shell adjacent to said top.

9. The assembly of claim 1, further comprising:

a plurality of first fasteners coupled to said inner surface of said shell; and a plurality of second fasteners, each said second fastener being coupled to a respective said panel, said second fasteners being complementary to said first fasteners wherein each said second fastener is positioned for selectively coupling to a respective said first fastener for coupling said respective said panel to said shell.

10. The assembly of claim 9, further including said plurality of second fasteners comprising eight said second fasteners positioned singly on opposing edges of four said panels, each said second fastener and said respective said first fastener comprising a hook and loop fastener.

11. The assembly of claim 1, further including said power module comprising:

a power supply unit;

a battery operationally coupled to said power supply unit, said battery being rechargeable;

a cable operationally coupled to said power supply unit, said cable being selectively extensible from said housing; and a cable connector coupled to a terminus of said cable wherein said cable connector is configured for coupling said cable to a source of alternating current for supplying alternating current to said power supply unit.

12. The assembly of claim 11, further including an adaptor selectively couplable to said cable connector, said adaptor comprising a cigarette lighter plug wherein said adaptor is configured for coupling said cable to a source of direct current for supplying direct current to said power supply unit.

13. The assembly of claim 1, further including a controller coupled to said rear wall of said housing, said controller being operationally coupled to said power module and said compressor wherein said controller is positioned for controlling a level of cooling of said interior space.

14. The assembly of claim 13, further including said controller comprising a knob, said knob being rotatable relative to said housing for selecting the level of cooling.

15. The assembly of claim 1, further comprising:

a strap;

a pair of first connectors, each said first connector being coupled to a respective opposing end of said strap; and a pair of second connectors, each said second connector being coupled to a respective opposing side of said shell proximate to said top, said second connectors being complementary to said first connectors wherein each said second connector is positioned for selectively coupling to a respective said first connector for coupling said strap to said shell wherein said strap is configured for positioning on a shoulder of the user for carrying said shell.

16. The assembly of claim 15, further comprising:

each said second connector comprising a ring; and each said first connector comprising a snap hook.

17. A cold storage assembly comprising:

a shell defining an interior space, said shell comprising membranous polymer such that said shell is flexible, said shell having a top, said top being open wherein said shell is configured for inserting items into said interior space, said shell being substantially rectangularly box shaped, said shell comprising an outer layer and an inner layer, said outer layer being insulated, said inner layer being thermally conductive;

a lid pivotally coupled to a back of said shell adjacent to said top wherein said lid is positioned for selectively closing said top;

a first coupler coupled to said shell proximate to said top;

a second coupler coupled to said lid, said second coupler being complementary to said first coupler wherein said second coupler is positioned for selectively coupling to said first coupler for coupling said lid to said shell for closing said top, said first coupler and said second coupler comprising a zipper, said zipper extending along a front and opposing sides of said shell adjacent to said top;

a plurality of panels selectively couplable to an inner surface of said shell such that said panels extend between said front and a back of said shell defining a plurality of compartments wherein said panels are configured for separating the items;

a plurality of first fasteners coupled to said inner surface of said shell;

a plurality of second fasteners, each said second fastener being coupled to a respective said panel, said second fasteners being complementary to said first fasteners wherein each said second fastener is positioned for selectively coupling to a respective said first fastener for coupling said respective said panel to said shell, said plurality of second fasteners comprising eight said second fasteners positioned singly on opposing edges of four said panels, each said second fastener and said respective said first fastener comprising a hook and loop fastener;

a cooling unit coupled to said shell, said cooling unit comprising an evaporator and a condenser wherein said cooling unit is positioned for cooling said interior space and the items positioned therein, said cooling unit comprising:

a housing defining an internal space, said housing being coupled to said back of said shell, said condenser being coupled to said housing and positioned in said internal space, a power module coupled to said housing and positioned in said internal space, said power module comprising:

a power supply unit, a battery operationally coupled to said power supply unit, said battery being rechargeable, a cable operationally coupled to said power supply unit, said cable being selectively extensible from said housing, a cable connector coupled to a terminus of said cable wherein said cable connector is configured for coupling said cable to a source of alternating current for supplying alternating current to said power supply unit, and an adaptor selectively couplable to said cable connector, said adaptor comprising a cigarette lighter plug wherein said adaptor is configured for coupling said cable to a source of direct current for supplying direct current to said power supply unit, a compressor coupled to said housing and positioned in said internal space, said compressor being operationally coupled to said power module, said evaporator, and said condenser, said evaporator comprising a conduit positioned between said outer layer and said inner layer, said conduit being coupled to and extending between said condenser and said compressor, said conduit being loopedly positioned in said back, a bottom, and said opposing sides of said shell, a plurality of slots positioned through a rear wall of said housing wherein said slots are configured for venting said internal space for cooling said condenser, a plurality of tubes, said tubes being pleated such that said tubes are flexible, each said tube being positioned in said conduit such that said tube is positioned around a respective edge of said shell wherein said tubes are configured for facilitating folding of said shell, an orifice positioned through said rear wall of said housing, a fan positioned in said orifice and coupled to said housing, said fan being operationally coupled to said power module wherein said fan is configured for forcing air through said internal space for cooling said condenser, and a controller coupled to said rear wall of said housing, said controller being operationally coupled to said power module and said compressor wherein said controller is positioned for controlling a level of cooling of said interior space, said controller comprising a knob, said knob being rotatable relative to said housing for selecting the level of cooling;

said shell comprising a medial layer positioned between said outer layer and said inner layer, said medial layer being thermally conductive, said conduit being positioned between said outer layer and said medial layer;

a phase-change material positioned between said inner layer and said medial layer wherein said phase-change material is configured for absorbing heat through said inner layer from said interior space for cooling said interior space and the items positioned therein, wherein said medial layer is configured for conducting heat from said phase-change material to said conduit for cooling said phase-change material;

a strap;

a pair of first connectors, each said first connector being coupled to a respective opposing end of said strap; and a pair of second connectors, each said second connector being coupled to a respective said opposing side of said shell proximate to said top, said second connectors being complementary to said first connectors wherein each said second connector is positioned for selectively coupling to a respective said first connector for coupling said strap to said shell wherein said strap is configured for positioning on a shoulder of the user for carrying said shell, each said second connector comprising a ring, each said first connector comprising a snap hook.

* * * * *